US006679686B2

(12) United States Patent
Wang

(10) Patent No.: US 6,679,686 B2
(45) Date of Patent: Jan. 20, 2004

(54) MOTOR-DRIVEN AIR PUMP WITH INFLATING AND DEFLATING MODES

(76) Inventor: Cheng-Chung Wang, 12F., No. 440, Sec. 4, Jeinai Rd., Taipei (TW)

( * ) Notice: Subject to any disclaimer, the term of this patent is extended or adjusted under 35 U.S.C. 154(b) by 58 days.

(21) Appl. No.: 10/164,896

(22) Filed: Jun. 6, 2002

(65) Prior Publication Data

US 2003/0099560 A1 May 29, 2003

(30) Foreign Application Priority Data

Nov. 28, 2001 (TW) ..... 90220593 U

(51) Int. Cl.[7] ..... F04B 35/04

(52) U.S. Cl. ..... 417/423.1; 417/423.14; 417/326; 417/423.15; 415/203; 415/205; 5/706; 5/708

(58) Field of Search ..... 5/706, 708, 710, 5/713; 417/423.1, 423.14, 424.1, 423.15, 326; 415/203, 204, 205, 206

(56) References Cited

U.S. PATENT DOCUMENTS 4,202,654 A * 5/1980 Marlow ..... 415/113
4,556,364 A * 12/1985 Barker ..... 415/172.1
4,869,076 A * 9/1989 Sakai et al. ..... 62/347
5,509,154 A * 4/1996 Shafer et al. ..... 5/713
6,073,305 A * 6/2000 Hesskamp ..... 15/405
6,162,016 A * 12/2000 Humbad ..... 415/204
6,332,760 B1 * 12/2001 Chung ..... 417/411
6,428,288 B1 * 8/2002 King ..... 417/366
6,568,905 B2 * 5/2003 Horng et al. ..... 415/206

* cited by examiner

*Primary Examiner*—Justine R. Yu
*Assistant Examiner*—Emmanuel Sayoc
(74) *Attorney, Agent, or Firm*—Akin Gump Strauss Hauer & Feld, L.L.P.

(57) ABSTRACT

In a motor-driven air pump, a bottom wall and a surrounding barrier wall cooperatively confine a receiving space in which an impeller is mounted. The barrier wall is provided with angularly displaced first and second internal ports that communicate fluidly with first and second chambers, respectively. A first external port is disposed upstream of and communicates with one of the first and second chambers. A second external port is disposed downstream of and communicates with the other one of the first and second chambers.

18 Claims, 8 Drawing Sheets

MOTOR-DRIVEN AIR PUMP WITH INFLATING AND DEFLATING MODES

CROSS-REFERENCE TO RELATED APPLICATION

This application claims priority of Taiwan Patent Application No. 90220593, filed on Nov. 28, 2001.

BACKGROUND OF THE INVENTION

1. Field of the Invention

The invention relates to a motor-driven air pump, more particularly to a motor-driven air pump that enables an impeller to operate at a relatively low idling pressure so as to result in speedy inflation and deflation of an inflatable object.

2. Description of the Related Art

Inflatable articles, such as inflatable mattresses and cushions, can be inflated to serve their intended purposes. As the inflatable articles generally occupy a large amount of space when in an inflated state of use, they are usually deflated after use so as to facilitate storage. Therefore, it would be most desirable if the process of inflation or deflation can be conducted in a very convenient and quick manner.

In a conventional motor-driven air pump for inflating and deflating inflatable articles, motors are used to drive an impeller to generate currents of air. As a known impeller is generally of an axial or centrifugal type, and will generate high idling pressures during operation, a powerful and often costly motor is needed in order to overcome the idling pressures while driving the impeller. As a consequence, the air pump will generate large amounts of heat after a short period of use.

BRIEF SUMMARY OF THE INVENTION

Therefore, the main object of the present invention is to provide a motor-driven air pump for inflating an inflatable object, which can overcome the aforesaid drawbacks associated with the prior art.

Another object of the present invention is to provide a motor-driven air pump for inflating and deflating an inflatable object, which can overcome the aforesaid drawbacks associated with the prior art.

A further object of the present invention is to provide an air pump-and-valve assembly for inflating and deflating an inflatable object, which can overcome the aforesaid drawbacks associated with the prior art.

According to one aspect of the invention, there is provided a motor-driven air pump for inflating an inflatable body. The air pump includes a bottom wall with a periphery; a surrounding barrier wall which extends upwardly from the periphery to terminate at a surrounding upper edge and which has an outer surrounding wall surface that surrounds an axis, and an inner surrounding wall surface opposite to the outer surrounding wall surface in radial directions and surrounding a receiving space. The surrounding barrier wall includes first and second inner peripheral. The first inner peripheral edges defining a first internal port and the second inner peripheral edges defining a second internal port. The first and second internal ports being in fluid communication with the receiving space.

A first chamber is positioned radially outwardly from the first inner peripheral edges and defines a first duct which extends in an axial direction that is parallel to the axis. The first duct is also positioned radially and outwardly from the surrounding barrier wall and communicates with the first internal port radially. A second chamber is positioned radially outwardly from the second inner peripheral edges and defines a second duct which extends in the axial direction. The second duct is also positioned radially and outwardly from the surrounding barrier wall and communicates with the second internal port radially.

A first external port is disposed proximate to the surrounding upper edge and communicates with the first duct such that the first external port is upstream of the first internal port when the first external port serves to introduce air in an inflating mode.

A second external port is adapted to be in fluid communication with the inflatable body. The second external port is disposed proximate to the bottom wall and communicates with the second duct.

An impeller is mounted in the receiving space and is rotatable relative to the bottom wall about the axis such that, in the inflating mode, when the impeller rotates to sweep by the first internal port, air that is introduced through the first external port will be entrained via the first internal port and will be impelled to enter into the second duct via the second internal port by virtue of centrifugal force for subequent passage through the second external port and into the inflatable body so as to inflate the inflatable body and speedily relieve the impeller from a back pressure that impedes movement of the impeller.

A drive motor is disposed to drive the impeller.

According to another aspect of the invention, there is provided a motor-driven air pump for inflating and deflating an inflatable body that includes a bottom wall with a periphery; a surrounding barrier wall which extends upwardly from the periphery to terminate at a surrounding upper edge and which has an outer surrounding wall surface that surrounds an axis, and an inner surrounding wall surface opposite to the outer surrounding wall surface in radial directions and surrounding a receiving space. The surrounding barrier wall including first and second inner peripheral edges spaced apart from each other. The first inner peripheral edges defining a first internal port and the second inner peripheral edges defining a second internal port. The first and second internal ports being in fluid communication with the receiving space. The second internal port being disposed behind the first internal port in a clockwise direction.

A first chamber is positioned radially outwardly from the first inner peripheral edges and defines a first duct which extends in an axial direction that is parallel to the axis. The first duct is also positioned radially and outwardly from the surrounding barrier wall and communicates with the first internal port radially.

A second chamber is positioned radially outwardly from the second inner peripheral edges and defines a second duct which extends in the axial direction. The second duct is also positioned radially and outwardly from the surrounding barrier wall and communicates with the second internal port radially.

A first external port is disposed proximate to the surrounding upper edge and communicating with the first duct such that the first external port is upstream of the first internal port when the first external port serves to introduce air in an inflating mode.

A second external port is adapted to be in fluid communication with the inflatable body, the second external port being disposed proximate to the bottom wall and communicating with the second duct such that the second external port is disposed upstream of the second internal port when the second external port serves to channel air released from the inflatable body in a deflating mode.

An impeller is mounted in the receiving space and rotatable relative to the bottom wall about the axis in the counterclockwise and clockwise directions, which correspond to the inflating and deflating modes, respectively, such that, in the inflating mode, when the impeller rotates in the counterclockwise direction to sweep by the first internal port, air that is introduced through the first external port will be entrained via the first internal port and will be impelled in the counterclockwise direction to enter into the second duct via the second internal port by virtue of centrifugal force for subsequent passage through the second external port and into the inflatable body so as to inflate the inflatable body and speedily relieve the impeller from a back pressure that impedes movement of the impeller; and such that, in the deflating mode, when the impeller rotates in the clockwise direction to sweep by the second internal port, air that is drawn out of the inflatable body through the second external port will be entrained via the second internal port and will be impelled in the clockwise direction to enter into the first duct via the first internal port by virtue of centrifugal force for subsequent escape through the first external port to thereby deflate the inflatable body.

A drive motor is disposed to drive the impeller to rotate in the clockwise or counterclockwise direction and a switch member is coupled to and controls the drive motor to drive the impeller to rotate in the clockwise or counterclockwise direction.

According to a further aspect of the invention, an air pump-and-valve assembly is adapted to be built in and secured sealingly to an inflatable body. The air pump-and-valve assembly includes a motor-driven air pump adapted for inflating and deflating an inflatable body. The air pump includes a bottom wall with a periphery; a surrounding barrier wall which extends from the periphery upwardly to terminate at a surrounding upper edge and which has an outer surrounding wall surface that surrounds an axis, and an inner surrounding wall surface opposite to the outer surrounding wall surface in radial directions and surrounding a receiving space. The surrounding barrier wall includes first inner peripheral edges and second inner peripheral edges spaced apart from each other. The first inner peripheral edges defining a first internal port and the second inner peripheral edges defining a second internal port. The first and second internal ports are in fluid communication with the receiving space. The second internal port is disposed behind the first internal port in a clockwise direction.

A first chamber is positioned radially outwardly from the first inner peripheral edges and defines a first duct which extends in an axial direction that is parallel to the axis. The first duct is also positioned radially and outwardly from the surrounding barrier wall and communicates with the first internal port radially.

A second chamber is positioned radially outwardly from the second inner peripheral edges and defines a second duct which extends in the axial direction. The second duct is also positioned radially outwardly from the surrounding barrier wall and communicates with the second internal port radially.

A first external port is adapted to be disposed externally of the inflatable body. The first external port being disposed proximate to the surrounding upper edge and communicating with the first duct such that the first external port is disposed upstream of the first internal port when the first external port serves to introduce air in an inflating mode.

A second external port is adapted to be disposed within the inflatable body and to be in fluid communication with the inflatable body. The second external port being disposed proximate to the bottom wall and communicating with the second duct such that the second external port is disposed upstream of the second internal port when the second external port serves to channel air released from the inflatable body in a deflating mode.

An impeller is mounted in the receiving space and is rotatable relative to the bottom wall about the axis in the counterclockwise and clockwise directions, which correspond to the inflating and deflating modes, respectively, such that, in the inflating mode, when the impeller rotates in the counterclockwise direction to sweep by the first internal port, air that is introduced through the first external port will be entrained via the first internal port and will be impelled in the counterclockwise direction to enter into the second duct via the second internal port by virtue of centrifugal force for subsequent passage through the second external port and into the inflatable body so as to inflate the inflatable body and speedily relieve the impeller from a back pressure which impedes movement of the impeller; and such that, in the deflating mode, when the impeller rotates in the clockwise direction to sweep by the second internal port, air that is drawn out of the inflatable body through the second external port will be entrained via the second internal port and will be impelled in the clockwise direction to enter into the first duct via the first internal port by virtue of centrifugal force for subsequent escape through the first external port to thereby deflate the inflatable body.

A drive motor is disposed to drive the impeller to rotate in the clockwise or counterclockwise direction.

A switch member is coupled to and controls the drive motor to drive the impeller to rotate in the clockwise or counterclockwise direction.

A closure member is disposed to close the first external port when the drive motor is deactivated so as not to drive the impeller to rotate in either one of the clockwise and counterclockwise directions.

BRIEF DESCRIPTION OF THE SEVERAL VIEWS OF THE DRAWINGS

Other features and advantages of the present invention will become apparent in the following detailed description of the preferred embodiments with reference to the accompanying drawings, of which.

DETAILED DESCRIPTION OF THE INVENTION

Figure 1:
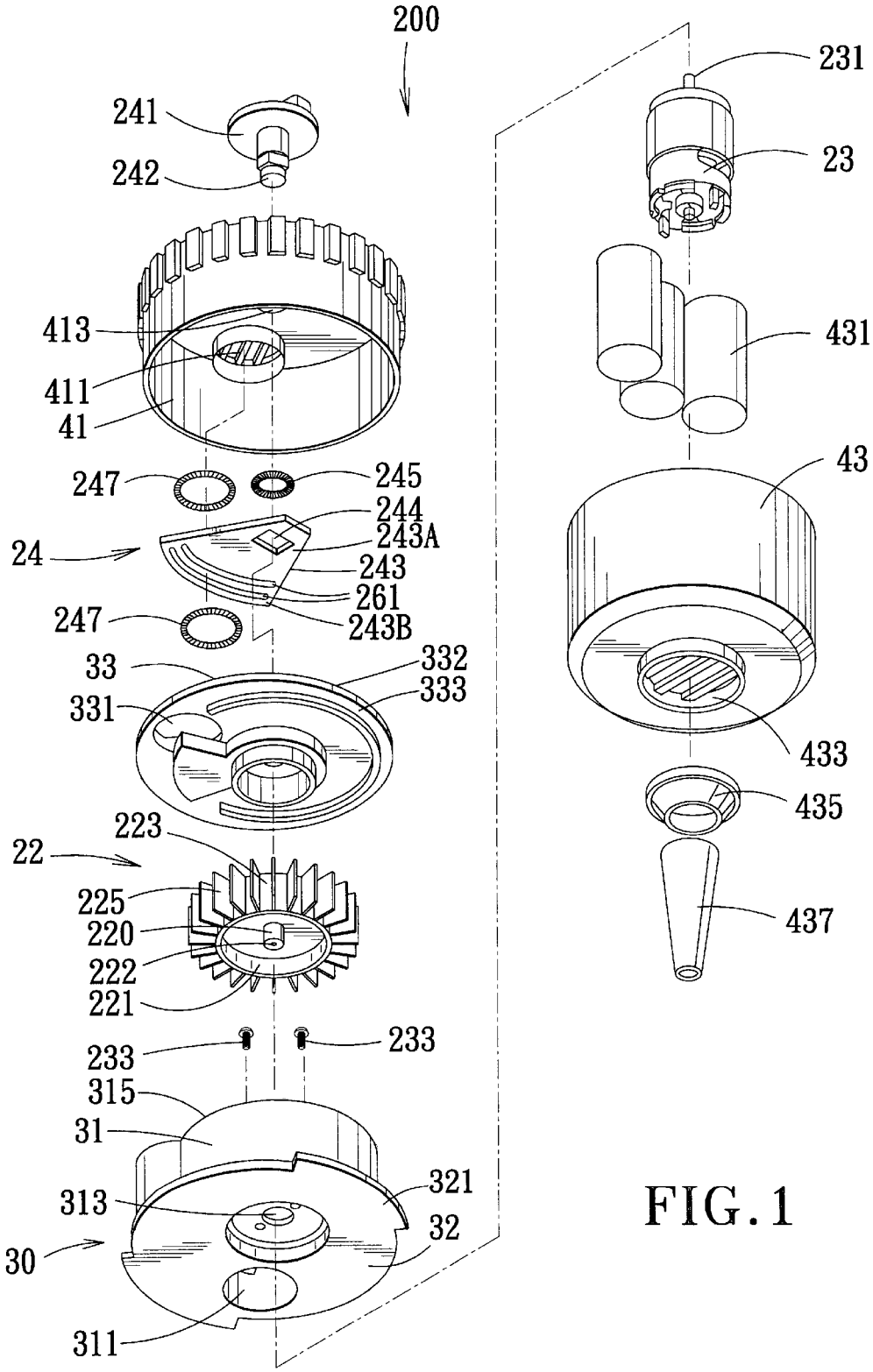
FIG. 1 is an exploded perspective view of the first preferred embodiment of a motor-driven air pump according to the invention, relevant wires being omitted for the sake of brevity.
Figure 2:
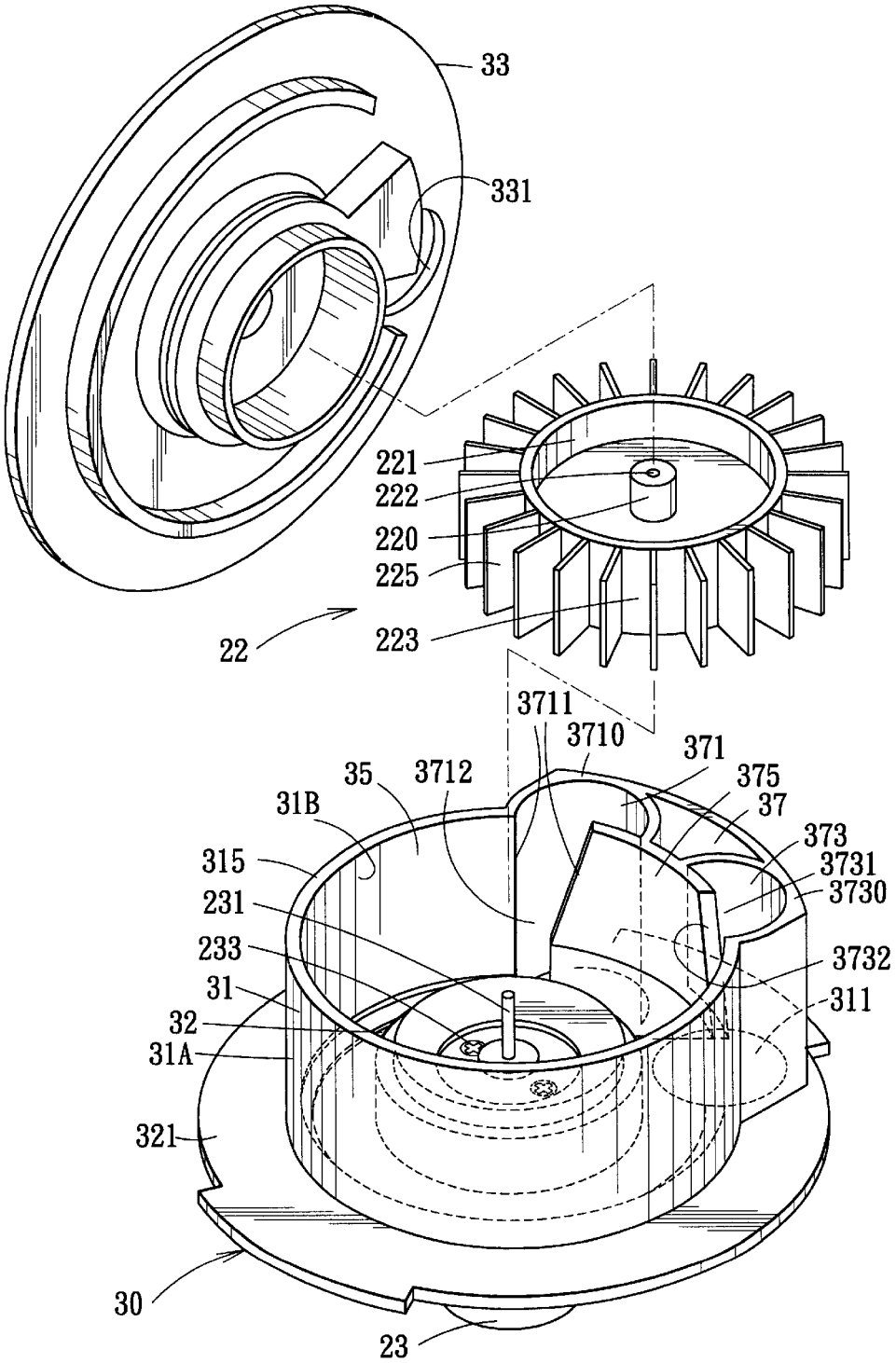
FIG. 2 is an exploded perspective view showing a casing having a motor mounted thereto, an impeller, and a support disk of the first preferred embodiment.
Figure 4:
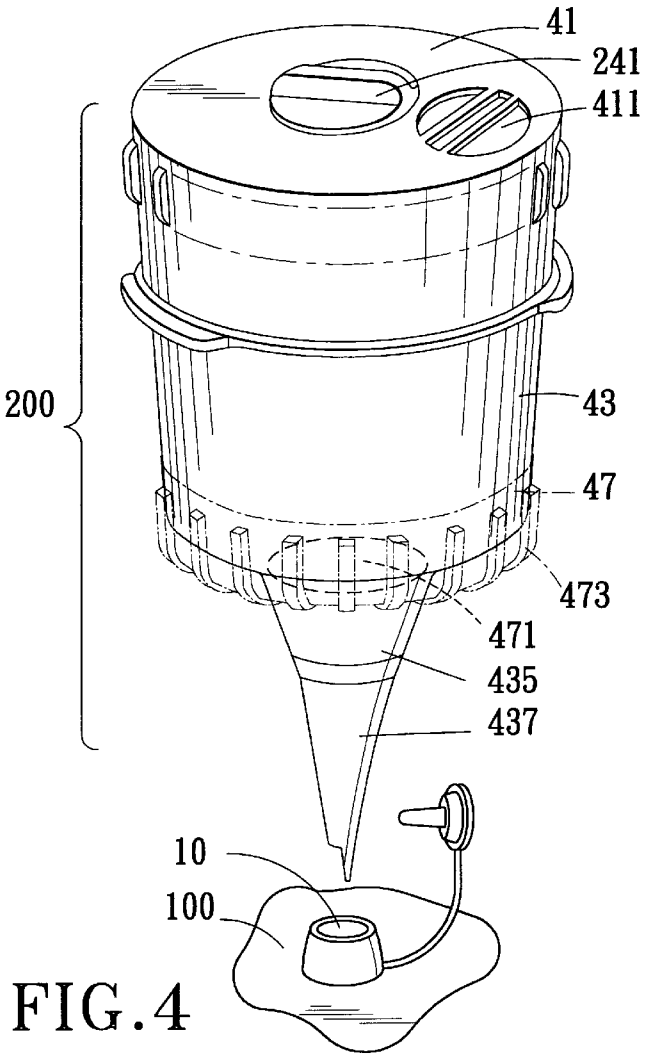
FIG. 4 is a perspective view of the first preferred embodiment when adapted to inflate an inflatable body.
Figure 3:
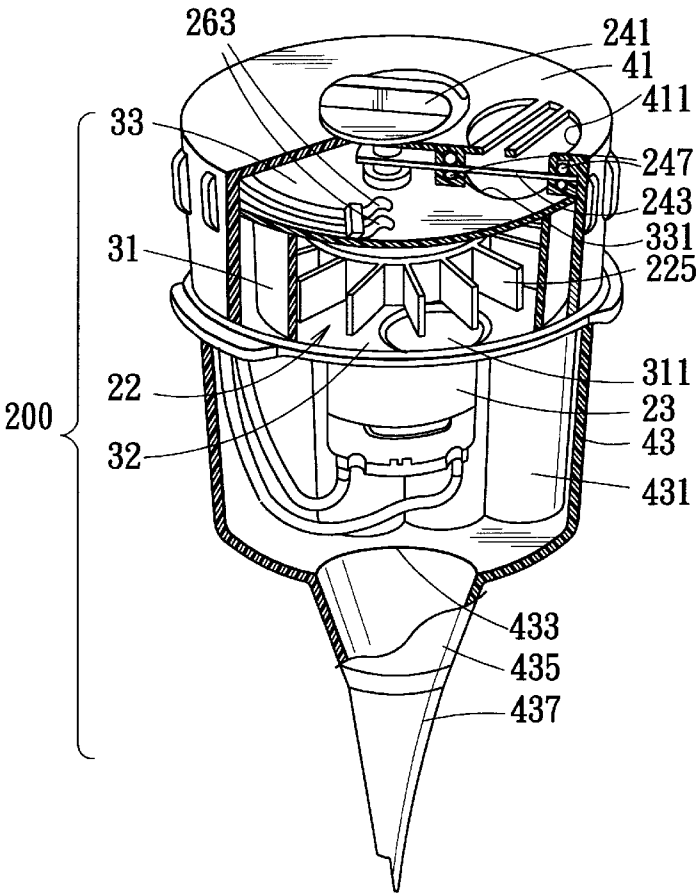
FIG. 3 is a partly cut-away perspective view of the first preferred embodiment in an assembled state.
Figure 5:
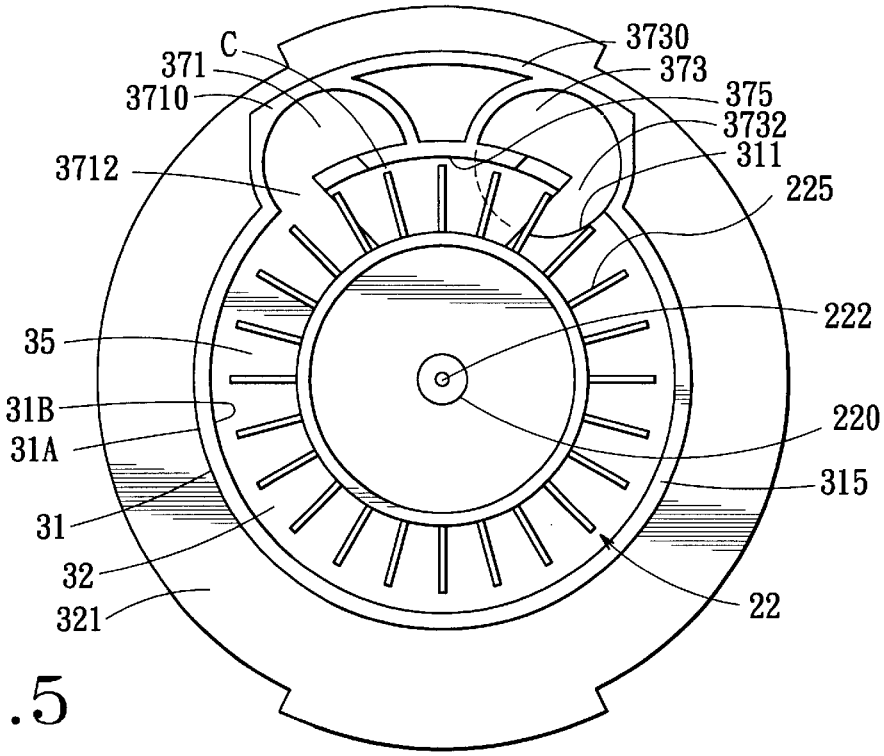
FIG. 5 is a schematic top view showing the impeller of the first preferred embodiment when mounted in the casing.

Referring to FIGS. 1 to 5, the first preferred embodiment of a motor-driven air pump 200 according to the present invention is adapted for inflating and deflating an inflatable body 100 (see FIG. 4), and is shown to include a casing 30, a support disk 33, an impeller 22, a drive motor 23, and a switch member 24. The casing 30 includes a bottom wall 32 with a periphery, and a surrounding barrier wall 31 which extends upwardly from the periphery to terminate at a surrounding upper edge 315 and which has outer and inner surrounding wall surfaces 31A, 31B. The outer surrounding wall surface 31A surrounds an axis. The inner surrounding wall surface 31B is opposite to the outer surrounding wall surface 31A in radial directions, and surrounds a receiving space 35. The surrounding barrier wall 31 includes first and second inner peripheral edges 3711, 3731 spaced apart from each other. The first inner peripheral edges 3711 define a first internal port 3712 and the second inner peripheral edges 3731 define a second internal port 3732. The first and second internal ports 3712, 3732 are in fluid communication with the receiving space 33. Each of the first and second internal ports 3712, 3732 extends in the axial direction and through the surrounding upper edge 315. The second internal port 3732 is disposed behind the first internal port 3712 in a clockwise direction. The part of the inner surrounding wall surface 31I that is disposed between the first and second internal ports 3712, 3732 defines a pressure relieving area 375. In addition, a first chamber 3710 is positioned radially outwardly from the first inner peripheral edges 3711, and defines a first duct 371 which extends in an axial direction that is parallel to the axis. The first duct is also positioned radially and outwardly from the surrounding barrier wall 31 and communicates with the first internal port 3712 radially. A second chamber 3730 is positioned radially outwardly from the second inner peripheral edges 3731, and defines a second duct 373 which extends in the axial direction. The second duct is also positioned radially and outwardly from the surrounding barrier wall 31 and communicates with the second internal port 3732 radially.

The support disk 33 is disposed over the surrounding upper edge 315 and the first and second chambers 3710, 3730 so as to shield the receiving space 35, the first duct 371 and the second duct 373 from sight in the axial direction. The support disk 33 has upper and lower major surfaces 332, 333 opposite to each other in the axial direction. The upper major surface 332 is provided with a first external port 331 that extends through the lower major surface 333 to communicate with the first duct 371. The first external port 331 is disposed proximate to the surrounding upper edge 315 and communicates with the first duct 371 such that the first external port 331 is upstream of the first internal port 3712 when the first external port 331 serves to introduce air in an inflating mode. In addition, an upper cover 41 is disposed to cover the support disk 33, and is provided with a fourth external port 411 that is registered with the first external port 331 in the axial direction.

A second external port 311 is provided to communicate fluidly with the inflatable body 100, and is disposed proximate to the bottom wall 32. The second external port 311 communicates with the second duct 373 such that the second external port 311 is disposed upstream of the second internal port 3732 when the second external port 311 serves to channel air released from the inflatable body 100. In this embodiment, the bottom wall 32 has an outward flange 321 extending integrally and outwardly from the periphery thereof. The second external port 311 is disposed in the outward flange 321 and extends radially into the bottom wall 32.

The impeller 22 is mounted in the receiving space 35, and is rotatable relative to the bottom wall 32 about the axis in counterclockwise and clockwise directions, which correspond to inflating and deflating modes, respectively. The impeller 22 includes a mounting post 220 with a center hole 222 along the axis, an annular frame 221 surrounding and connected to the mounting post 220, and a plurality of equi-distantly spaced blades 225 extending radially outward from an outer peripheral surface 223 of the annular frame 221. The impeller 22 is configured such that the smallest clearance (C)(see FIG. 5) is left between the blades 225 and the pressure relieving area 375 to prevent back flow of air that is entrained into the receiving space 35 through the first and second internal ports 3712, 3732.

The drive motor 23 is disposed to drive the impeller 22 to rotate in the clockwise and counterclockwise directions, and is a known carbon brush electric motor in this embodiment. The drive motor 23 is fixed to a lower side of the bottom wall 32 via two screws 233, and includes an output shaft 231 which extends uprightly through a hole 313 in the bottom wall 32 and into the receiving space 35. The output shaft 231 further extends along the axis into the center hole 222 in the mounting post 220 of the impeller 22 so as to mount the impeller 22 fixedly on the output shaft 231. It is noted that, after the impeller 22 and the support disk 33 are duly positioned, there is hardly any fluid communication between a space within the annular frame 221 and the receiving space 35 outside the annular frame 221. A battery unit 431 (e.g., a plurality of rechargeable battery cells) is connected electrically to the drive motor 23 so as to supply power thereto. A lower cover 43 is disposed to enclose the drive motor 23 and accommodate the battery unit 431 therein. It is noted that the drive motor 23 can be alternatively connected to an external power source (not shown), and that the provision of the battery unit 431 facilitates the supply of power when the air pump 200 is used outdoors. The lower cover 43 has a bottom side provided with a third external port 433 that is registered with and that communicates fluidly with the second external port 311. A large-diameter inflation nozzle 435 can be connected to the third external port 433 for inflating the inflatable body 100 or for further connection with a small-diameter inflation nozzle 437, whereby the air pump 200 can be adapted to inflate or deflate inflatable objects with filling holes of different diameters. Furthermore, a protective cover 47 formed from a soft plastic material can be provided to shield a lower portion of the lower cover 43, as shown by the phantom lines in FIG. 4. The protective cover 47 is formed with an opening 471 that communicates fluidly with the third and second external ports 433, 311. The protective cover 47 can be provided with a plurality of ribs 473 to serve as a buffer against impact.

Figure 6:
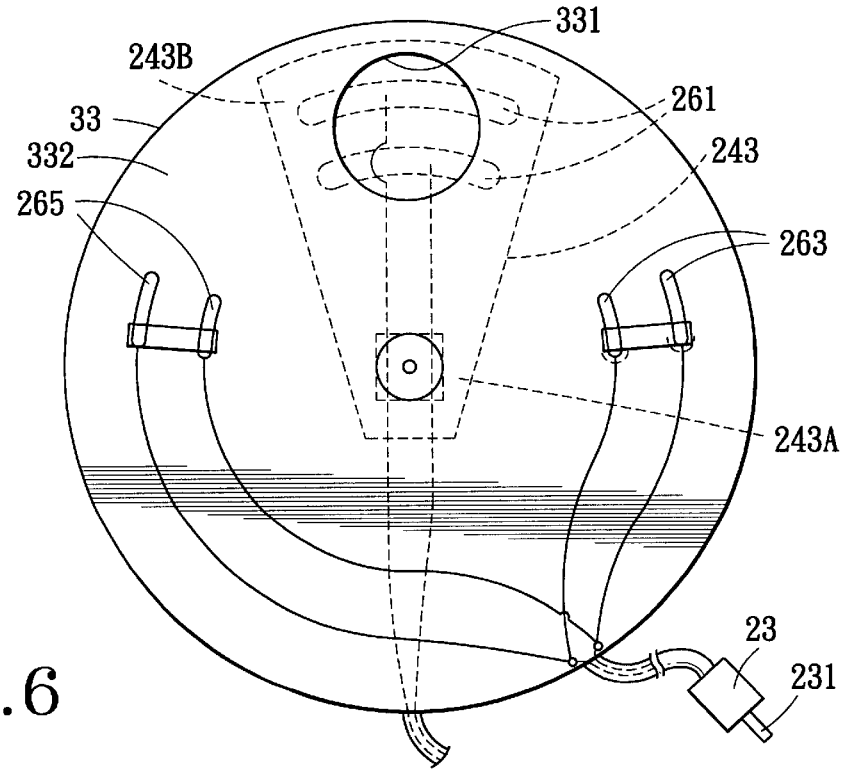
FIG. 6 is a schematic top view of an upper major surface of the support disk, illustrating how a switching unit closes a first external port in the support disk.
Figure 7:
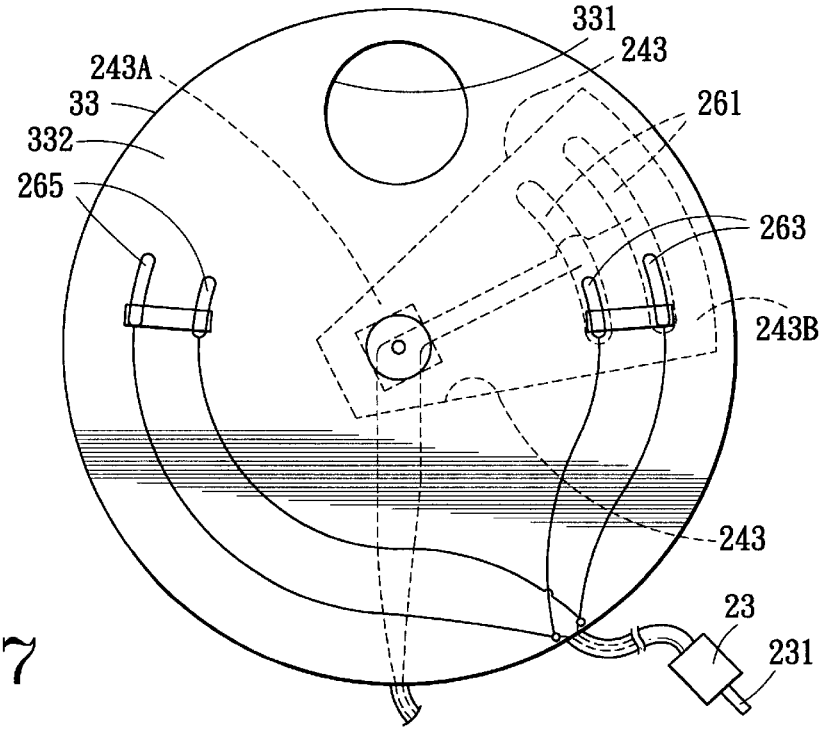
FIG. 7 is a schematic top view of the upper major surface of the support disk, illustrating how connection is established between the switching unit and a first terminal set.
Figure 8:
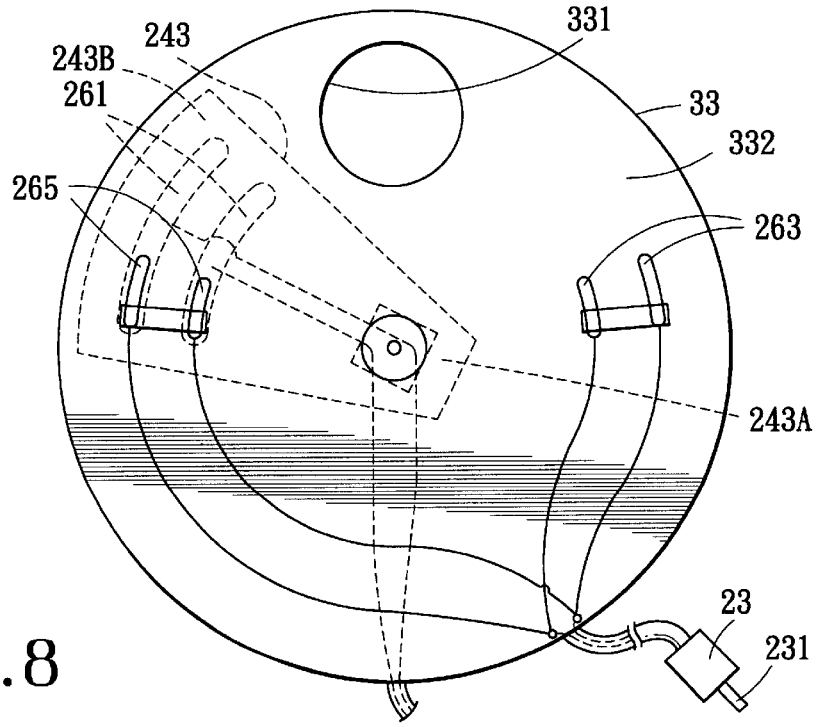
FIG. 8 is a view similar to FIG. 7, illustrating how connection is established between the switching unit and a second terminal set.

With further reference to FIGS. 6 to 8, the switch member 24 is coupled to and controls the drive motor 23 to drive the impeller 22 to rotate in the clockwise or counterclockwise direction, and includes first and second terminal sets 263, 265 and a switching unit 243. The first and second terminal sets 263, 265 are disposed on the upper major surface 332 of the support disk 33, are angularly spaced apart from each other, and are connected electrically and respectively to the drive motor 23, the first eternal port 331 being angularly disposed between the first and second terminals 263, 265. The switching unit 243, which is generally fan-shaped in this embodiment, has a pivoting end 243A and a contact end 243B. The pivoting end 243A is provided with a square through hole 244. The contact end 243B is disposed opposite to the pivoting end 243A radially, and has a power terminal set 261 disposed on a lower surface thereof. The switching unit 243 is turnable between a first contact position where the power terminal set 261 on the contact end 243B is in electric contact with the first terminal set 263 on the support disk 33 to actuate the drive motor 23 to drive the impeller 22 to rotate in the counterclockwise direction, and a second contact position where the power terminal set 261 on the contact end 243B is in electric contact with the second terminal set 265 on the support disk 33 to actuate the drive motor 23 to drive the impeller 22 to rotate in the clockwise direction. The contact end 243B can also serve as a closure member for closing the first external port 331 so as to equip the air pump 200 of the invention with a valve function. The switch member 24 further includes a rotary knob 241 that is operable to switch the contact end 243B between the first and second contact positions, and that includes a post 242 formed with a square end portion. The post 242 extends through an insert hole 413 in the upper cover 41 and the square through hole 244 in the pivoting end 243A so that the square end portion is retained in the square through hole 244 to enable turning of the switching unit 243 with the rotary knob 241. A packing ring 245 is interposed between the insert hole 413 and the square through hole 244 to prevent undesirable friction between the upper cover 41 and the pivoting end 243A and to ensure air-tightness. Two O-rings 247 are disposed on upper and lower surfaces of the contact end 243B and can be brought to air-tightly engage two peripheral edges which respectively confine the fourth and first external ports 411, 331, respectively, so as to interrupt fluid communication between the fourth and first external ports 411, 331.

When the air pump 200 of the invention is used to inflate the inflatable body 100, a suitable one of the inflation nozzles 435, 437 is fitted to the third external port 433, and is inserted into a filling hole 10 in the inflatable body 100. By turning the rotary knob 241 to bring the switching unit 243 to the first contact position so that the power terminal set 261 contacts the first terminal set 263 (see FIG. 7), the drive motor 23 is actuated to drive the impeller 22 to rotate in the counterclockwise direction in the inflating mode. At this time, as the fourth external port 411 is registered with the first external port 331, ambient air can be introduced via the fourth external port 411 and the first external port 331 into the first duct 371, and is entrained via the first internal port 3712 into the receiving space 35 when the impeller 22 sweeps by the first internal port 3712. The entrained air is then impelled in the counterclockwise direction to enter into the second duct 373 via the second internal port 3732 as a result of centrifugal force. The air then passes through the second external port 311 and the third external port 433 into the inflatable body 100 to inflate the same. Due to the configuration of the invention, back flow of air toward the first internal port 3712 is prevented during the inflation process, and the impeller 22 can operate in an environment where the impeller 22 can be quickly relieved of idling pressure that impedes movement thereof, thereby speeding up the inflation process.

In the deflating mode, the rotary knob 241 is operated to turn the switching unit 243 to the second contact position so that the power terminal set 261 on the contact end 243B contacts the second terminal set 265 (see FIG. 8) to actuate the drive motor 23 to drive the impeller 22 to rotate in the clockwise direction. When the impeller 22 sweeps by the second internal port 3732, air is drawn out from the inflatable body 100 via the second external port 311 and the second duct 373 and is entrained via the second internal port 3732 into the receiving space 35. The air is then impelled in the clockwise direction to enter into the first duct 371 via the first internal port 3712 as a result of centrifugal force for subsequent escape to the outside through the first external port 331 and the fourth external port 411, thereby deflating the inflatable body 100.

It is noted that the switch member 24 can have various known configurations and can be disposed in any appropriate position, so long as the drive motor 23 can be actuated to drive the impeller 22 to rotate in the clockwise and counterclockwise directions. In addition, the upper cover 41 and the lower cover 43 can be dispensed with. In the former case, the switch member 24 can be directly arranged on the support disk 33 or elsewhere in a known manner, with means to selectively seal the first external port 331, if desired. In the latter case, the inflation nozzles 435, 437 can be directly connected to the second external port 311 via known interlocking means.

Figure 9:
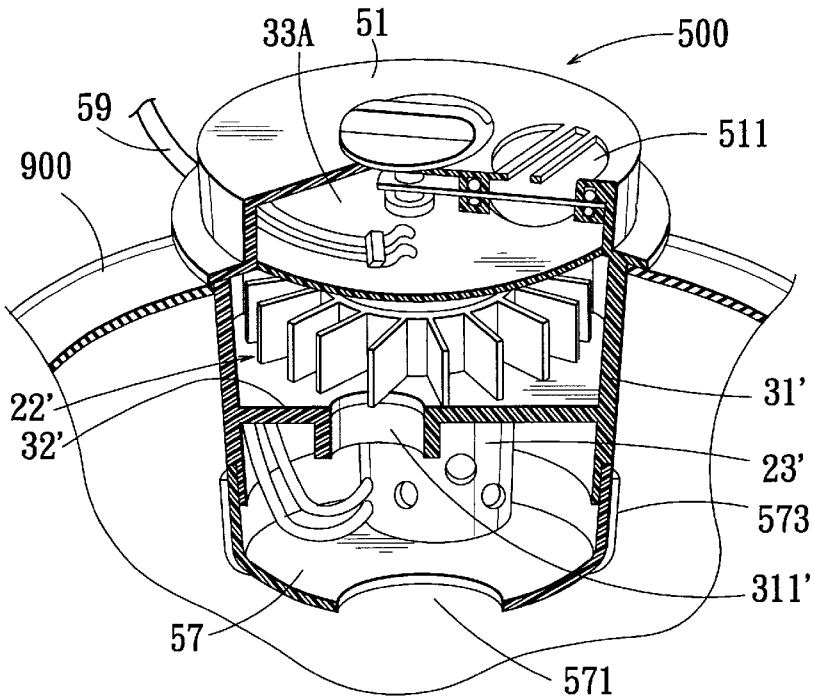
FIG. 9 is a partly cut-away perspective view of the second preferred embodiment of a motor-driven air pump according to the invention.

FIG. 9 shows the second preferred embodiment of a motor-driven air pump 500 according to the invention. This embodiment is substantially the same as the previous embodiment in construction, the difference therebetween residing mainly in that this embodiment is built in an inflatable body 900 so as to achieve an inflatable with a built-in pump, and that a surrounding barrier wall 31' extends upwardly from a bottom wall 32' and is sealingly secured to the inflatable body 900. The surrounding barrier wall 31' further extends downwardly to surround a drive motor 23' mounted below an impeller 22' and connected to a power cord 59. A soft protective cover 57 is sleeved on a bottom portion of the surrounding barrier wall 31' for protection purposes. The protective cover 57 is provided with an external port 571 that communicates with an external port 311' in the bottom wall 32' and is located within the inflatable body 900. Thus, there is no need for any inflation nozzle. The protective cover 57 is further provided with a plurality of ribs 573 to provide a buffering effect against impact. An upper cover 51 is disposed to cover a support disk 33A, and is provided with an external port 511 that is adapted to be disposed externally of the inflatable body 900.

Figure 10:
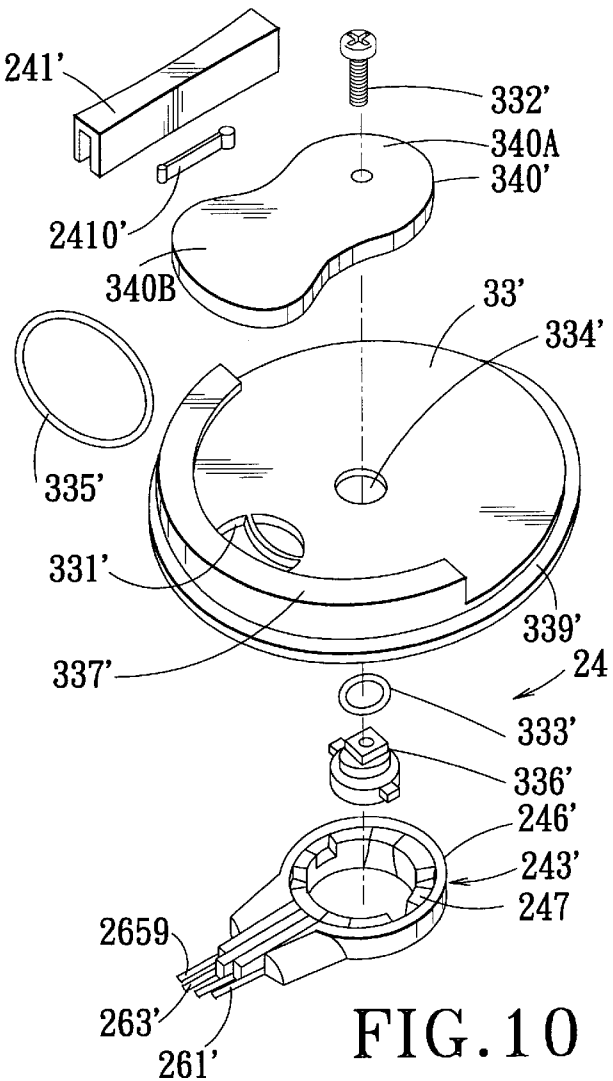
FIG. 10 is an exploded perspective view showing another embodiment of a switch member according to the invention.
Figure 11:
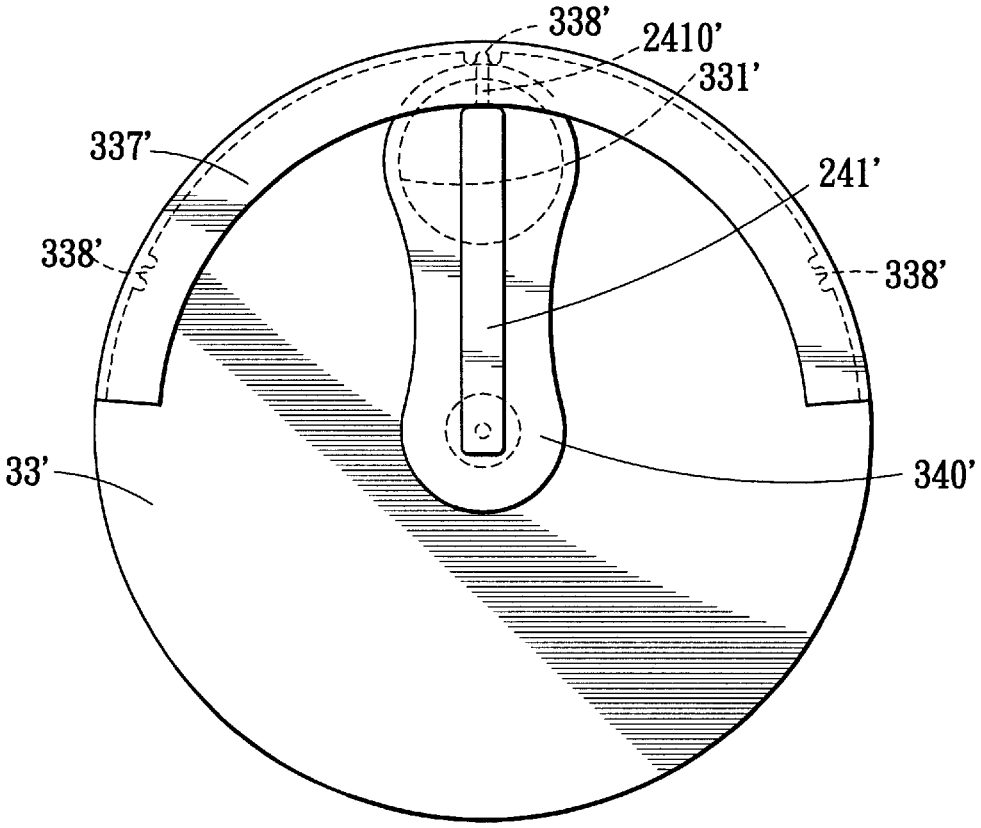
FIG. 11 is an assembled schematic top view of the switch member of FIG. 10.

FIGS. 10 and 11 illustrate another embodiment of a switch member 24' according to the invention. The switch member 24' comprises a switching unit 243' which includes a switch seat 246' disposed below a support disk 33', first and second terminals 263', 265' disposed on the switch seat 246' and connected electrically to a drive motor (not shown), and a contact portion 247' rotatably mounted in the switch seat 246' and provided with a power terminal set 261' connected to two poles of a power source (not shown). It is noted that the arrangement of the first and second terminals 263', 265' and the power terminal set 261' on the switch seat 246' is known in the art, and a detailed description thereof is dispensed with herein for the sake of brevity. The contact portion 247' is rotatable relative to the switch seat 246' between a first contact position where the contact portion 247' is in electric contact with the first terminal 263' to actuate the drive motor (not shown) to drive an impeller (not shown) to rotate in the counterclockwise direction, and a second contact position where the contact portion 247' is in electric contact with the second terminal 265' to actuate the drive motor (not shown) to drive the impeller (not shown) to rotate in the clockwise direction. The switching unit 243' further includes an actuator 336' operable so as to rotate the contact portion 247' between the first and second contact positions. A screw 332' is extended through an axial hole 334' in the support disk 33' to threadedly engage the actuator 336', and serves as an actuating end therefor. A packing ring 333' can be disposed between the support disk 33' and the actuator 336' to ensure air-tightness therebetween.

Furthermore, a closure member 340' in the form of a plate is mounted slidably on the support disk 33' to cover a first external port 331' therein. The closure member 340' includes a mounting end 340A through which the screw 332' extends, and a closure end 340B that is operable to close the first external port 331'. An O-ring 335' can be disposed between the closure end 340B and the first external port 331' for enhancing the sealing effect. In addition, an arcuate guiding groove 337' is provided to extend along a part of an outer periphery of the support disk 33' between first and second positions that correspond to the first and second contact positions for guiding sliding movement of the closure member 340'.

The switch member 24' further includes a rotary knob 241' fixed to the closure member 33' and operable so as to rotate the closure member 340' via the screw 332'. The rotary knob 241' accommodates therein an elastic strip 2410' that has a tip extending therefrom to engage one of three notches 338' formed in the guiding groove 337' and corresponding to the first and second positions and the first external port 331'. A clicking sound will be generated when the tip of the elastic strip 2410' engages one of the notches 338' to let the user know that the closure member 340' has moved to a desired position.

Furthermore, the support disk 33' can be provided with an outward flange 339' adapted for sealing connection with an inflatable body (not shown).

Figure 12:
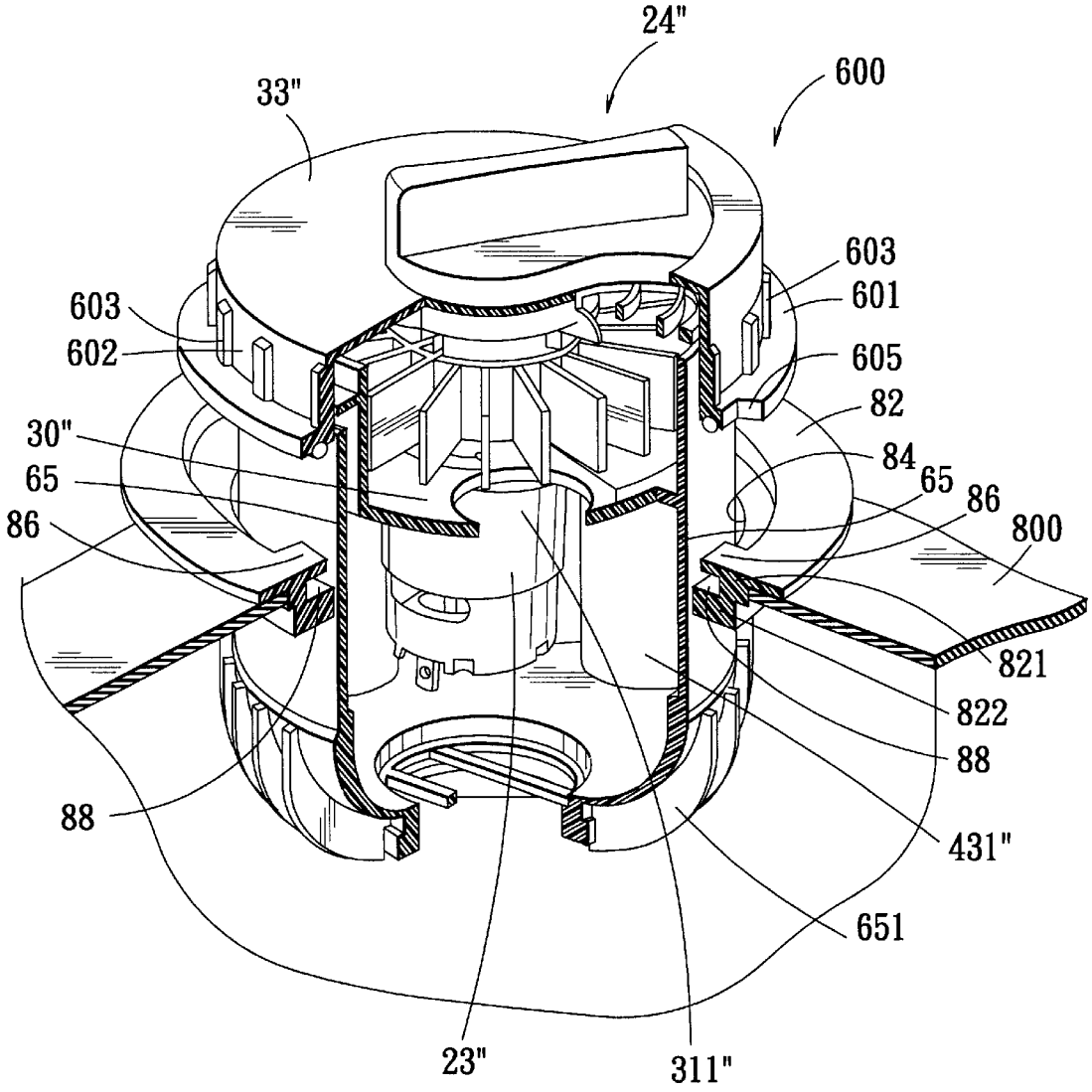
FIG. 12 is a partly cut-away perspective view of the third preferred embodiment of a motor-driven air pump according to the invention in an assembled state.

FIG. 12 shows the third preferred embodiment of a motor-driven air pump 600 according to the present invention. This embodiment is similar to the second preferred embodiment, the difference therebetween residing mainly in that the air pump 600 is not secured directly to an inflatable body 800, but is connected removably to the inflatable body 800. In this embodiment, the air pump 600 includes a switch member 24" of the type shown in FIGS. 10 and 11 and described hereinbefore and mounted on a support disk 33". In this embodiment, the support disk 33" has an outer periphery and a circumferential wall 602 that extends downwardly from the outer periphery. The support disk 33" includes a support flange 601 extending outwardly and radially from the circumferential wall 602, and a plurality of spaced-apart anti-skid ribs 603 disposed around the circumferential wall 602. The support flange 601 is provided with a plurality of notches 605 that are angularly displaced from each other. The air pump 600 further includes a protective surrounding wall 65 surrounding and connected to a casing 30". The protective surrounding wall 65 extends downwardly to enclose a motor 23" and a battery unit 431". The battery unit 431" is connected electrically to the switch member 24" and the motor 23", and can be rechargeable battery cells. In addition, a soft protective cover 651 can be disposed around a lower portion of the protective surrounding wall 65 to further protect the air pump 600. Furthermore, there is provided an annular seat 82 which is adapted to be formed with the inflatable body 800 so as to confine an insert hole 84 that is adapted to be in fluid communication with the inflatable body 800. The annular seat 82 includes an upper annular portion 821 having a first dimension and a lower annular portion 822 having a second dimension that is smaller than the first dimension so as to define an annular shoulder 88 therebetween. The upper annular portion 821 has an inner periphery which is provided with a plurality of retaining blocks 86 that project radially and inwardly therefrom to mate respectively with the notches 605 in the support flange 601. In use, the air pump 600 is inserted into the insert hole 84 such that the notches 605 mate with the retaining blocks 86 to permit the support flange 601 to rest on the shoulder 88. The air pump 600 is then rotated relative to the annular seat 82 such that removal of the air pump 600 from the inflatable body 800 is prevented by the retaining blocks 86 and such that an air-tight seal is established between the support disk 33" and the annular seat 82. Inflation or deflation of the inflatable body 800 can then proceed using the air pump 600 in the manner as described hereinabove.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A motor-driven air pump for inflating an inflatable body, said air pump comprising:

a bottom wall with a periphery;

a surrounding barrier wall which extends upwardly from said periphery to terminate at a surrounding upper edge and which has an outer surrounding wall surface that surrounds an axis, and an inner surrounding wall surface opposite to said outer surrounding wall surface in radial directions and surrounding a receiving space, said surrounding barrier wall including first inner peripheral edges and second inner peripheral edges spaced apart from each other, said first inner peripheral edges defining a first internal port and said second inner peripheral edges defining a second internal port, said first and second internal ports in fluid communication with said receiving space;

a first chamber positioned radially outwardly from said first inner peripheral edges and defining a first duct which extends in an axial direction that is parallel to the axis, said first duct also positioned radially and outwardly from said surrounding barrier wall and communicating with said first internal port radially;

a second chamber positioned radially outwardly from said second inner peripheral edges and defining a second duct which extends in the axial direction, said second duct also positioned radially and outwardly from said surrounding barrier wall and communicating with said second internal port radially;

a first external port disposed proximate to said surrounding upper edge and communicating with said first duct such that said first external port is upstream of said first internal port when said first external port serves to introduce air in an inflating mode;

a second external port adapted to be in fluid communication with the inflatable body, said second external port being disposed proximate to said bottom wall and communicating with said second duct;

an impeller mounted in said receiving space and rotatable relative to said bottom wall about the axis such that, in the inflating mode, when said impeller rotates to sweep by said first internal port, air that is introduced through said first external port will be entrained via said first internal port and will be impelled to enter into said second duct via said second internal port by virtue of centrifugal force for subsequent passage through said second external port and into the inflatable body so as to inflate the inflatable body and speedily relieve said impeller from a back pressure that impedes movement of said impeller; and a drive motor disposed to drive said impeller.

2. A motor-driven air pump for inflating and deflating an inflatable body, said air pump comprising:

a bottom wall with a periphery;

a surrounding barrier wall which extends upwardly from said periphery to terminate at a surrounding upper edge and which has an outer surrounding wall surface that surrounds an axis, and an inner surrounding wall surface opposite to said outer surrounding wall surface in radial directions and surrounding a receiving space, said surrounding barrier wall including first inner peripheral edges and second inner peripheral edges spaced apart from each other, said first inner peripheral edges defining a first internal port and said second inner peripheral edges defining a second internal port, said first and second internal ports in fluid communication with said receiving space, said second internal port being disposed behind said first internal port in a clockwise direction;

a first chamber positioned radially outwardly from said first inner peripheral edges and defining a first duct which extends in an axial direction that is parallel to the axis, said first duct also positioned radially and outwardly from said surrounding barrier wall and communicating with said first internal port radially;

a second chamber positioned radially outwardly from said second inner peripheral edges and defining a second duct which extends in the axial direction, said second duct also positioned radially and outwardly from said surrounding barrier wall and communicating with said second internal port radially;

a first external port disposed proximate to said surrounding upper edge and communicating with said first duct such that said first external port is upstream of said first internal port when said first external port serves to introduce air in an inflating mode;

a second external port adapted to be in fluid communication with the inflatable body, said second external port being disposed proximate to said bottom wall and communicating with said second duct such that said second external port is disposed upstream of said second internal port when said second external port serves to channel air released from the inflatable body in a deflating mode;

an impeller mounted in said receiving space and rotatable relative to said bottom wall about the axis in the counterclockwise and clockwise directions, which correspond to the inflating and deflating modes, respectively, such that, in the inflating mode, when said impeller rotates in the counterclockwise direction to sweep by said first internal port, air that is introduced through said first external port will be entrained via said first internal port and will be impelled in the counterclockwise direction to enter into said second duct via said second internal port by virtue of centrifugal force for subsequent passage through said second external port and into the inflatable body so as to inflate the inflatable body and speedily relieve said impeller from a back pressure that impedes movement of said impeller; and such that, in the deflating mode, when said impeller rotates in the clockwise direction to sweep by said second internal port, air that is drawn out of the inflatable body through said second external port will be entrained via said second internal port and will be impelled in the clockwise direction to enter into said first duct via said first internal port by virtue of centrifugal force for subsequent escape through said first external port to thereby deflate the inflatable body;

a drive motor disposed to drive said impeller to rotate in the clockwise or counterclockwise direction; and a switch member coupled to and controlling said drive motor to drive said impeller to rotate in the clockwise or counterclockwise direction.

3. The motor-driven air pump according to claim 2, wherein said inner surrounding wall surface includes a pressure relieving area interposed between said first and second internal ports, said impeller being configured such that a small clearance is left between said impeller and said pressure relieving area to prevent back flow of the air that is entrained into said receiving space through said first or second internal ports.

4. The motor-driven air pump according to claim 2, wherein said drive motor includes an output shaft extending uprightly through said bottom wall into said receiving space and along the axis, said impeller being mounted fixedly on said output shaft.

5. The motor-driven air pump according to claim 4, further comprising a support disk disposed over said surrounding upper edge and said first and second chambers so as to shield said receiving space, said first duct and said second duct from sight in the axial direction, said switch member including: first and second terminals disposed on said support disk and spaced apart from each other, said first and second terminals being connected electrically to said drive motor; and a switching unit having a pivoting end pivoted to said support disk and a contact end disposed opposite to said pivoting end radially, said switching unit being turnable between a first contact position where said contact end is in electric contact with said first terminal to actuate said drive motor to drive said impeller to rotate in the counterclockwise direction, and a second contact position where said contact end is in electric contact with said second terminal to actuate said drive motor to drive said impeller to rotate in the clockwise direction.

6. The motor-driven air pump according to claim 5, wherein said support disk has upper and lower major surfaces opposite to each other in the axial direction, said upper major surface being provided with said first external port that extends through said lower major surface to communicate with said first duct.

7. The motor-driven air pump according to claim 6, wherein each of said first and second internal ports extends in the axial direction and through said surrounding upper edge.

8. The motor-driven air pump according to claim 4, further comprising a support disk disposed over said surrounding upper edge and said first and second chambers so as to shield said receiving space, said first duct and said second duct from sight in the axial direction, said switch member including a switching unit which includes: a switch seat disposed below said support disk and having first and second terminals disposed thereon, said first and second terminals being connected electrically to said drive motor; a contact portion mounted in said switch seat and rotatable relative to said switch seat between a first contact position where said contact portion is in electric contact with said first terminal to actuate said drive motor to drive said impeller to rotate in the counterclockwise direction, and a second contact position where said contact portion is in electric contact with said second terminal to actuate said drive motor to drive said impeller to rotate in the clockwise direction; and an actuator operable so as to rotate said contact portion between said first and second contact positions and having an actuating end extending through said support disk and along the axis.

9. The motor-driven air pump according to claim 8, wherein said support disk has upper and lower major surfaces opposite to each other in the axial direction, said upper major surface being provided with said first external port, which extends through said lower major surface to communicate with said first duct.

10. An air pump-and-valve assembly adapted to be built in and secured sealingly to an inflatable body, said assembly comprising:

a motor-driven air pump adapted for inflating and deflating the inflatable body, said air pump including:

a bottom wall with a periphery;

a surrounding barrier wall which extends from said periphery upwardly to terminate at a surrounding upper edge and which has an outer surrounding wall surface that surrounds an axis, and an inner surrounding wall surface opposite to said outer surrounding wall surface in radial directions and surrounding a receiving space, said surrounding barrier wall including first inner peripheral edges and second inner peripheral edges spaced apart from each other, said first inner peripheral edges defining a first internal port and said second inner peripheral edges defining a second internal port, said first and second internal ports in fluid communication with said receiving space, said first internal port being adapted to be disposed externally of the inflatable body, said second internal port being disposed within the inflatable body and behind said first internal port in a clockwise direction;

a first chamber positioned radially outwardly from said first inner peripheral edges and defining a first duct which extends in an axial direction that is parallel to the axis, said first duct also positioned radially and outwardly from said surrounding barrier wall and communicating with said first internal port radially;

a second chamber positioned radially outwardly from said second inner peripheral edges and defining a second duct which extends in the axial direction, said second duct also positioned radially and outwardly from said surrounding barrier wall and communicating with said second internal port radially;

a first external port adapted to be disposed externally of the inflatable body, said first external port being disposed proximate to said surrounding upper edge and communicating with said first duct such that said first external port is disposed upstream of said first internal port when said first external port serves to introduce air in an inflating mode;

a second external port adapted to be disposed within the inflatable body and to be in fluid communication with the inflatable body, said second external port being disposed proximate to said bottom wall and communicating with said second duct such that said second external port is disposed upstream of said second internal port when said second external port serves to channel air released from the inflatable body in a deflating mode;

an impeller mounted in said receiving space and rotatable relative to said bottom wall about the axis in the counterclockwise and clockwise directions, which correspond to the inflating and deflating modes, respectively, such that, in the inflating mode, when said impeller rotates in the counterclockwise direction to sweep by said first internal port, air that is introduced through said first external port will be entrained via said first internal port and will be impelled in the counterclockwise direction to enter into said second duct via said second internal port by virtue of centrifugal force for subsequent passage through said second external port and into the inflatable body so as to inflate the inflatable body and speedily relieve said impeller from a back pressure which impedes movement of said impeller; and such that, in the deflating mode, when said impeller rotates in the clockwise direction to sweep by said second internal port, air that is drawn out of the inflatable body through said second external port will be entrained via said second internal port and will be impelled in the clockwise direction to enter into said first duct via said first internal port by virtue of centrifugal force for subsequent escape through said first external port to thereby deflate the inflatable body;

a drive motor disposed to drive said impeller to rotate in the clockwise or counterclockwise direction;

a switch member coupled to and controlling said drive motor to drive said impeller to rotate in the clockwise or counterclockwise direction; and a closure member disposed to close said first external port when said drive motor is not actuated to drive said impeller to rotate in either one of the clockwise and counterclockwise directions.

11. The air pump-and-valve assembly according to claim 10, wherein said drive motor includes an output shaft extending uprightly through said bottom wall into said receiving space and along the axis, said impeller being mounted fixedly on said output shaft.

12. The air pump-and-valve assembly according to claim 11, wherein said air pump further includes a support disk disposed over said surrounding upper edge and said first and second chambers so as to shield said receiving space, said first duct and said second duct from sight in the axial direction, said switch member including: first and second terminals disposed on said support disk and spaced apart from each other, said first and second terminals being connected electrically to said drive motor; and a switching unit having a pivoting end pivoted to said support disk and a contact end disposed opposite to said pivoting end radially, said switching unit being turnable between a first contact position where said contact end is in electric contact with said first terminal to actuate said drive motor to drive said impeller to rotate in the counterclockwise direction, and a second contact position where said contact end is in electric contact with said second terminal to actuate said drive motor to drive said impeller to rotate in the clockwise direction.

13. The air pump-and-valve assembly according to claim 12, wherein said support disk has upper and lower major surfaces opposite to each other in the axial direction, said upper major surface being provided with said first external port that extends through said lower major surface to communicate with said first duct.

14. The air pump-and-valve assembly according to claim 13, wherein said first external port is disposed between said first and second terminals, said closure member being disposed on and being formed integrally with said contact end so as to close said first external port when said drive motor is deactivated.

15. The air pump-and-valve assembly according to claim 11, wherein said air pump further includes a support disk disposed over said surrounding upper edge and said first and second chambers so as to shield said receiving space, said first duct and said second duct from sight in the axial direction, said switch member including a switching unit which includes: a switch seat disposed below said support disk and having first and second terminals disposed thereon, said first and second terminals being connected electrically to said drive motor; a contact portion mounted in said switch seat and rotatable relative to said switch seat between a first contact position where said contact portion is in electric contact with said first terminal to actuate said drive motor to drive said impeller to rotate in the counterclockwise direction, and a second contact position where said contact portion is in electric contact with said second terminal to actuate said drive motor to drive said impeller to rotate in the clockwise direction; and an actuator operable so as to rotate said contact portion between said first and second contact positions and having an actuating end extending through said support disk and along the axis.

16. The air pump-and-valve assembly according to claim 15, wherein said support disk has upper and lower major surfaces opposite to each other in the axial direction, said upper major surface being provided with said first external port, which extends through said lower major surface to communicate with said first duct.

17. The air pump-and-valve assembly according to claim 16, wherein said closure member has a mounting end mounted on said actuating end of said actuator, and a closure end that is operable so as to close said first external port.

18. The air pump-and-valve assembly according to claim 17, further comprising an annular seat adapted to be formed with the inflatable body so as to confine an insert hole that is adapted to be in fluid communication with the inflatable body, said annular seat including an upper annular portion having a first dimension and a lower annular portion having a second dimension that is smaller than said first dimension so as to define an annular shoulder therebetween, said upper annular portion having an inner periphery which is provided with a plurality of retaining blocks that project radially and inwardly therefrom and that are displaced angularly from each other, said support disk further having an outer periphery and a circumferential wall that extends downwardly from said outer periphery, and including a support flange which extends outwardly and radially from said circumferential wall and which is disposed to be seated on said shoulder, said support flange being provided with a plurality of notches that are spaced from each other and that are disposed to mate respectively with said retaining blocks such that, when said air pump is inserted into said insert hole and is rotated relative to said annular seat, removal of said air pump from the inflatable body is prevented by said retaining blocks and such that an air-tight seal is established between said support disk and said annular seat.

* * * * *